US007628629B2

(12) United States Patent
Miyazaki et al.

(10) Patent No.: US 7,628,629 B2
(45) Date of Patent: Dec. 8, 2009

(54) CONNECTOR

(75) Inventors: Takehide Miyazaki, Kawasaki (JP); Hirofumi Imabayashi, Kawasaki (JP); Katsumi Kanasaki, Kawasaki (JP); Hideaki Yajima, Kawasaki (JP); Kazuya Nishida, Kawasaki (JP); Akira Okada, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 12/389,767

(22) Filed: Feb. 20, 2009

(65) Prior Publication Data

US 2009/0215288 A1 Aug. 27, 2009

(30) Foreign Application Priority Data

Feb. 27, 2008 (JP) ..... 2008-046273

(51) Int. Cl.
*H01R 13/64* (2006.01)

(52) U.S. Cl. ..... 439/248; 439/660

(58) Field of Classification Search ..... 439/74, 439/246, 247, 248, 660
See application file for complete search history.

(56) References Cited

U.S. PATENT DOCUMENTS

| | | | | |
|---|---|---|---|---|
| 5,376,009 | A * | 12/1994 | Olsson et al. | 439/67 |
| 5,499,924 | A * | 3/1996 | Arisaka et al. | 439/67 |
| 5,769,651 | A * | 6/1998 | Omura et al. | 439/248 |
| 6,354,855 | B2 * | 3/2002 | Annequin | 439/248 |
| 6,390,829 | B1 * | 5/2002 | Rademacher | 439/74 |
| 6,506,069 | B2 * | 1/2003 | Babala et al. | 439/248 |
| 7,118,389 | B2 * | 10/2006 | Fork et al. | 439/74 |

FOREIGN PATENT DOCUMENTS

| | | |
|---|---|---|
| JP | 2002-329556 | 11/2002 |
| JP | 2005-005096 | 1/2005 |
| JP | 2005-166302 | 6/2005 |

* cited by examiner

*Primary Examiner*—Thanh-Tam T Le
(74) *Attorney, Agent, or Firm*—Staas & Halsey LLP

(57) ABSTRACT

A connector for electrically connecting with a first circuit board and a second circuit board, the connector includes a female connector and a male connector. The female connector includes a housing, a moveable side electrode capable of moving in the housing and an elastic member biasing the moveable side electrode, the moveable side electrode having a recess. The male connector includes a projection with a tip end being fitted into the recess of the moveable side electrode.

7 Claims, 11 Drawing Sheets

RELATED ART

CONNECTOR

CROSS-REFERENCE TO RELATED APPLICATION

This application is based upon and claims the benefit of priority of the prior Japanese Patent Application No. 2008-46273, filed on Feb. 27, 2008, the entire contents of which are incorporated herein by reference.

FIELD

A certain aspect of the embodiments discussed herein is related to a connector for electrical connection.

BACKGROUND

Power supply circuits for supplying a power to each electronic component mounted onto a printed circuit board are integrated into one portion near the edge of the circuit board in many cases. Such a power supply circuit decreases a relatively high voltage supplied from the outside of the board down to a low voltage for each electronic component (each device) and applies the voltage to each electronic component. However, in recent years, a voltage for each electronic component mounted onto the circuit board tends to decrease, while a current value for each electronic component tends to increase. Under the above circumstances, such a system as supplies a current to each electronic component in a concentrated manner from power supply circuits integrated at one portion on the board has a problem that a circuit length to supply a current from the power supply circuit to each electronic component is increased and a voltage is lowered on its way to the component.

As a main countermeasure against the problem is adopted a distributed current supplying system where a compact, high-speed-response power supply is provided near each of components on the circuit board, which require a power. According to such a distributed current supplying system, although a current path up to the compact power supply circuit on the board is long, a current value of a current flowing therethrough is high, so an influence of voltage drop is small. Further, a current path of a low voltage that is reduced at the compact power supply circuit, up to each electronic component can be shortened. Thus, an influence of voltage drop on the path of a current supplied from each power supply circuit to each electronic component in the circuit, can be suppressed.

Moreover, a recent tendency is to downsize a circuit board along with reduction in product size and yet, to increase the number of electronic components mounted onto the circuit board. The circuit board is proceeding toward compact/high-density mounting. Following this tendency, a method of mounting electronic components onto a so-called mother board and mounting a power supply circuit is mounted onto a so-called daughter board to connect these boards with an electrical connector, is generally employed.

Even in the case of using the mother board and the daughter board, it is possible to integrate power supply circuit to one portion on the daughter board and supply a power from the daughter board to each electronic component on the mother board by the use of a connector including many pins. However, this configuration involves the aforementioned problem of voltage drop. To that end, a distributed power supply system is adopted; in the system, power supply circuit 2 are distributed on a daughter board 1 in accordance with positions of electronic components 5 arranged on a mother board 4, and a power is supplied from each power supply circuit 2 to the mother board 4 using many connectors 3 as illustrated in FIGS. 1A and 1B.

The above distributed power supply system where the power supply circuit 2 are distributed on the daughter board 1 and a power is supplied from each power supply circuit 2 to the electronic components 5 on the mother board 4 using many connectors 3, follows the rule that the power supply circuits 2 may provide near the electronic components 5. However, in this example, plural connectors 3 are used, which causes a problem that plural connectors 3 may not be fitted properly due to mounting tolerances of the plural connectors 3, and if forcedly fitted, the connectors 3 cause any defect.

A detailed description thereof is given with reference to FIGS. 2A and 2B. To precisely fit the connectors 3 provided on each of the mother board 4 and the daughter board 1, coordinates of the connector 3 on the mother board 4 and coordinates of the connector 3 on the daughter board 1 should match each other when the boards are bonded. FIGS. 2A and 2B illustrate coordinates of the connector 3 on the mother board 4 and coordinates of the connector 3 on the daughter board 1. The respective coordinates involve tolerance. Provided that the lower right position of each board in the figures is set as the origin, the coordinates of the connector 3 on the mother board 4 is expressed by ($Xm1\pm\alpha$, $Ym1\pm\alpha$). The tolerance $\pm\alpha$ is a combination of tolerance $\pm A$ involved in pattern formation on the board and tolerance $\pm B$ involved in arrangement of the connectors 3 on the pattern. More specifically, tolerance $\pm\alpha=(\pm A\pm B)$. Further, the shape of the board 4 also has the tolerance $\pm\beta$.

The tolerances are each on the order of 0.1 mm. However, at the worst, the plural connectors 3 involve the sum of the maximum values of the tolerances. Accordingly, in such cases, the plural connectors 3 mounted to the mother board 4 and the daughter board 1 cannot be engaged properly only by adjusting positions of the mother board 4 and the daughter board 1.

To overcome the problem, prior art disclose a movable connector that can be moved relative to the other connector when fitted thereto. A movable connector disclosed in FIGS. 2 and 6 of Japanese Laid-open Patent Publication No. 2002-329556 includes a stationary housing and a movable housing, and the movable housing can be moved within a movable range of a spring of the stationary housing. Electric connection between a circuit pattern on a circuit board and the connector is established by pressing the connector to the circuit pattern by utilizing spring property of a connecting terminal (contact) provided at the bottom of the movable housing.

Further, an electrical connector disclosed in Japanese Laid-open Patent Publication No. 2005-166302 (FIGS. 3 to 5) is structured such that a sliding mechanism is provided to a stationary member and a housing on a circuit board to allow the connector to move only in a horizontal direction. Further, an electrical connector disclosed in Japanese Laid-open Patent Publication No. 2005-005096 (FIGS. 8 to 16) includes a connector plug and a connector socket composed of a stationary portion and a movable portion. The stationary portion of the connector plug has projections at four positions. By inserting the projections to holes formed in the movable portion, the stationary portion and the movable portion can be assembled. A space between the outer edge of the stationary portion and the inner edge of the movable portion is a movable range of the movable portion. A terminal of the movable portion is set wide so as to establish electrical connection with the stationary portion. Further, a terminal of the stationary portion protrudes downwardly before assembly to maintain electrical connection to the stationary portion even if being moved after assembly.

However, the movable connector as disclosed in the Japanese Laid-open Patent Publication No. 2002-329556 includes many contacts, which are thin and long due to spring property thereof and have a high electric resistance, resulting in a problem that the connector is inappropriate to supply a large current. Further, the electrical connector as disclosed in the Japanese Laid-open Patent Publication No. 2005-166302 also includes many contacts and is not intended to absorb various tolerances of the upper and lower boards upon engagement, resulting in a problem that the connector is inappropriate to connect the upper and lower boards with plural connectors. Further, the electrical connector as disclosed in the Japanese Laid-open Patent Publication No. 2005-005096 is intended to connect printed boards together but its terminal is thin and long and has a high electrical resistance similar to the Japanese Laid-open Patent Publication No. 2002-329556, resulting in a problem that the connector is inappropriate to supply a large current.

SUMMARY

According to an aspect of the invention, a connector for electrically connecting with a first circuit board and a second circuit board, the connector comprising:

a female connector including a housing having a terminal and an opening, the opening arranged on the top of the housing and having an inner size, the terminal arranged at bottom side of the housing and fixing on the first circuit board, a moveable side electrode having a diameter smaller than the inner size of the opening and a recess on top of the housing, the moveable side electrode arranged in the housing between the housing and the first circuit board, the moveable side electrode capable of moving in the housing, and an elastic member arranged between the housing and the moveable side electrode, the elastic member urging to the moveable side electrode and for contact between a circuit pattern on the first circuit board and the moveable side electrode when the housing sets on the first circuit board; and a male connector including a base portion fixed the second circuit board; and a stationary side electrode including a projection with a tip end, the tip end being fitted into the recess of the moveable side electrode.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

Embodiments will be described with reference to the accompanying drawings.

An aspect of embodiment is a connector for electrically connecting two boards together. According to the connector, even if plural connectors are provided on the boards to be connected, mounting tolerances of the connectors can be absorbed and a large current can be supplied with a simple structure.

Figure 1A:
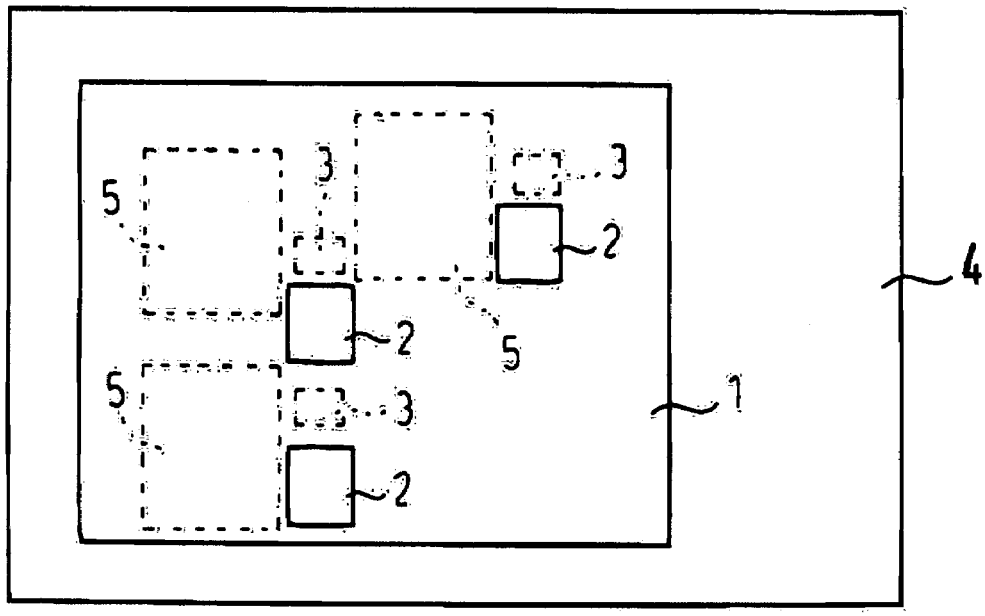
RELATED ART Fig. 1A
FIG. 1A is a plan view of a conventional mother board where electronic components are arranged and a conventional daughter board where power supplies are distributed with the boards being connected together by means of a connector.
Figure 1B:
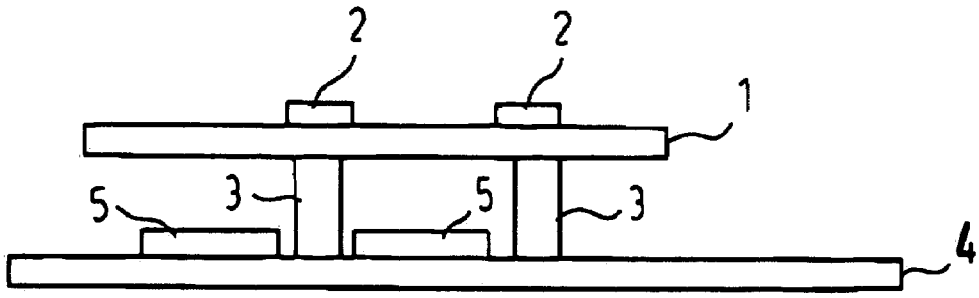
RELATED ART Fig. 1B
FIG. 1B is a side view of the mother board and the daughter board of FIG. 1A.
Figure 2A:
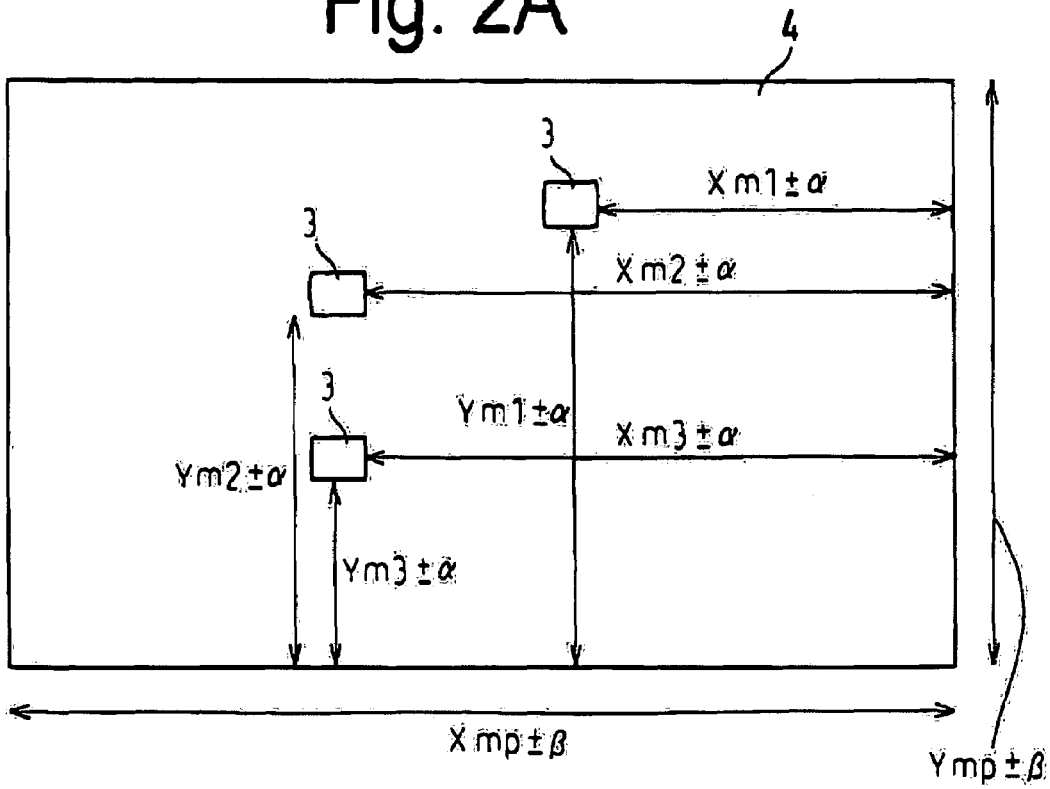
RELATED ART Fig. 2A
FIG. 2A is a plan view illustrating tolerances of mounting dimensions of plural connectors mounted to a mother board.
Figure 2B:
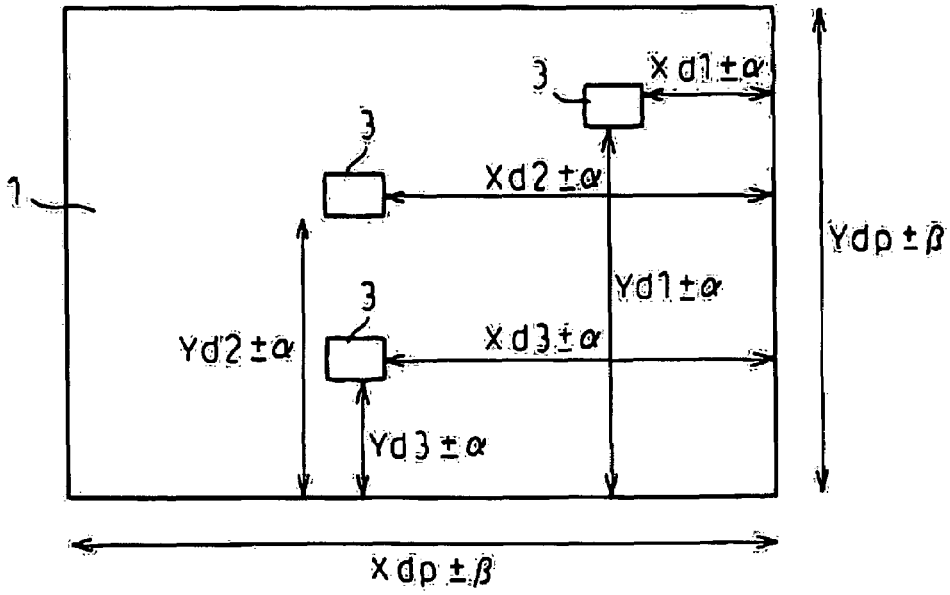
FIG. 2B is a plan view illustrating tolerances of mounting dimensions of plural connectors mounted to a daughter board.
Figure 3A:
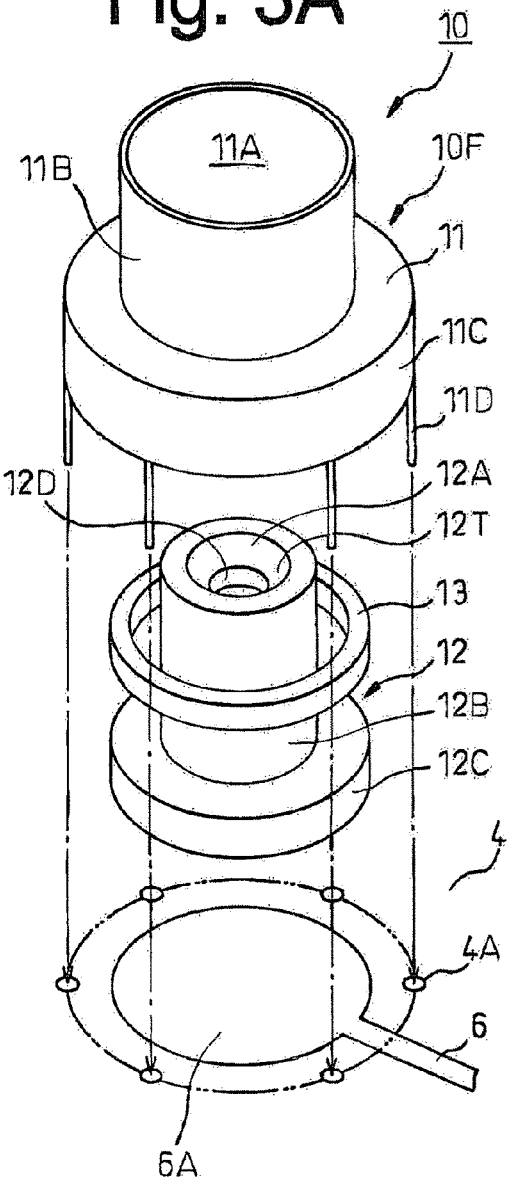
FIG. 3A is an exploded perspective view of a female connector of a movable connector according to a first embodiment.

FIG. 3A illustrates the structure of a female connector 10F of a movable connector 10 according to a first embodiment. The female connector 10F includes a housing 11, a movable side electrode 12, and an elastic member 13. The housing 11 of the first embodiment is formed in a cylindrical shape with a small diameter portion 11B having an opening 11A and a large diameter portion 11C having an inner size larger than the small diameter portion 11B. Plural lead terminals 11D extend from a lower edge of the large diameter portion 11C. A land portion 6A of a circuit pattern 6 is provided at a mounting position of the housing 11 on a mother board 4. Mounting holes 4A for mounting the housing 11 are formed around the land portion 6A. The housing 11 is fixed onto the mother board 4 by inserting the lead terminals 11D into the mounting holes 4A formed in the mother board 4.

The movable side electrode 12 is made of a conductive material and formed into a cylindrical shape with a small diameter portion 12B having a recess 12A formed at the top thereof and a large diameter portion 12C having an outer size larger than the small diameter portion 12B. The movable side electrode 12 is accommodated in the housing 11, so the outer dimension of the small diameter portion 12B of the movable side electrode 12 is smaller than the inner dimension of the small diameter portion 11B of the housing 11 by a predetermined amount, and the outer dimension of the large diameter portion 12C is smaller than the inner dimension of the large diameter portion 11C of the housing 11 by a predetermined amount. The recess 12A is formed by a taper surface 12T and a cylindrical portion 12D. The cylindrical portion 12D is continuous to the taper surface 12T.

The elastic member 13 has a ring shape and is made of sponge or rubber. The outer diameter of the elastic member 13 is substantially equal to the outer diameter of the large diameter portion 12C of the movable side electrode 12. The small diameter portion 12B of the movable side electrode 12 is passed through the elastic member 13, and the elastic member 13 is put on the top of the large diameter portion 12C. In this state, the housing 11 is put thereon and mounted onto the mother board 4 as illustrating in FIG. 3B. Under such a condition that the lead terminals 11D of the housing 11 are soldered and fixed to the mother board 4, as illustrating in FIG. 3C, the elastic member 13 is compressed to press the bottom surface of the movable side electrode 12 against the mother board 4 and bring the movable side electrode 12 into abutment therewith. More specifically, the elastic member 13 urges the movable side electrode 12.

Figure 3B:
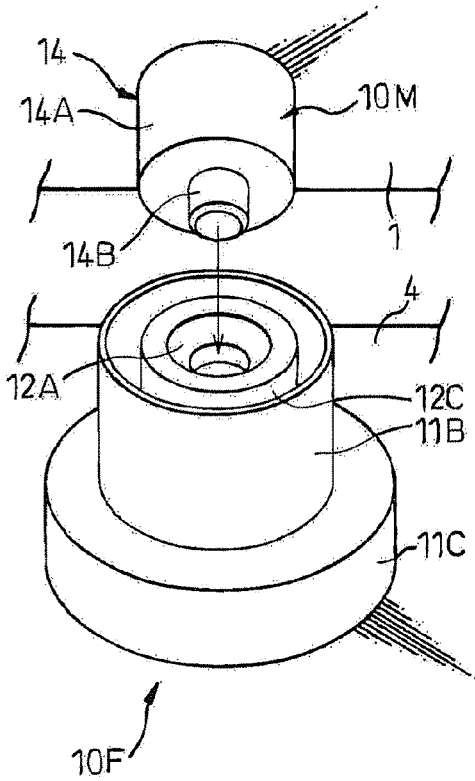
FIG. 3B is a perspective view illustrating engagement between the female connector of FIG. 3A and a male connector of the first embodiment.

FIG. 3B illustrates the thus-structured female connector 10F and a male connector 10M to be engaged therewith. The male connector 10M is made of a conductive material and constitutes a stationary side electrode 14 including a base portion 14A to be attached to a daughter board 1 and a projection 14B that protrudes from the base portion 14A. In the first embodiment, the base portion 14A is cylindrical with the diameter almost equal to that of the small diameter portion 12B of the movable side electrode 12 of the female connector 10F. Further, the projection 14B has a shape to fit the cylindrical portion 12D of the recess 12A of the movable side electrode 12 of the female connector 10F.

Figure 3C:
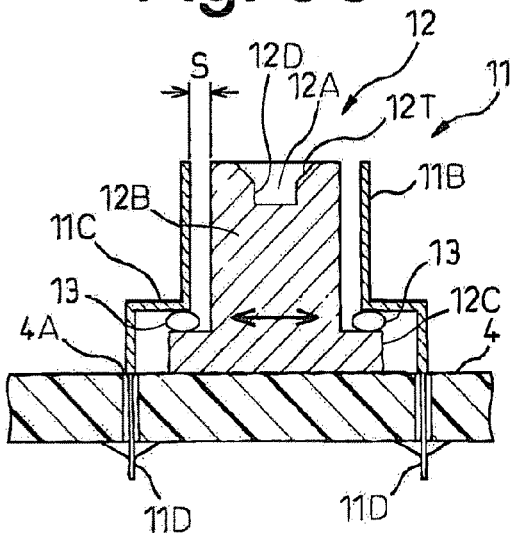
FIG. 3C is a sectional view of the female connector of FIG. 3B is mounted to a board.

As illustrating in FIG. 3C, under such a condition that the female connector 10F is mounted to the mother board 4, there is a space S between the outer peripheral portion of the small diameter portion 12B of the movable side electrode 12 and the inner peripheral portion of the small diameter portion 11B of the housing 11 with the central axes of the housing 11 and the movable side electrode 12 being aligned with each other. A spaced between the outer peripheral portion of the large diameter portion 12C of the movable side electrode 12 and the inner peripheral portion of the large diameter portion 11C of the housing 11 needs only to be equal to or larger than the space S. The space S is set equal to or larger than the mounting tolerance of the connector mounted to the board.

Figure 4A:
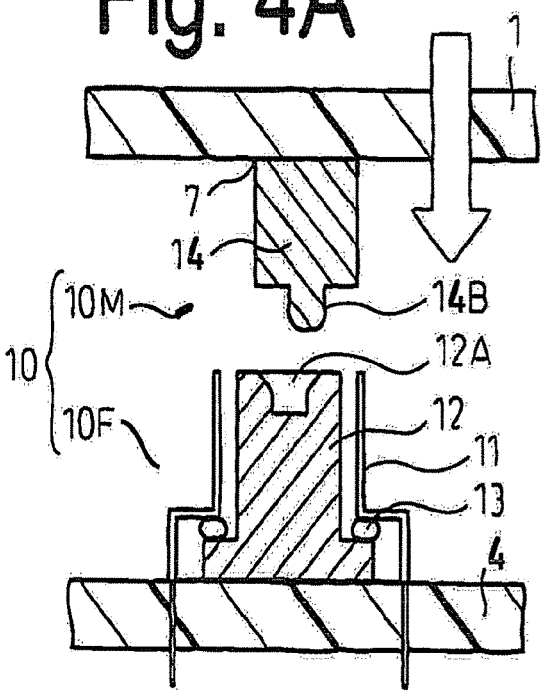
FIG. 4A illustrates how the male connector is misaligned with the female connector before engagement between the female connector and the male connector of the first embodiment as illustrated in FIG. 3B.

FIG. 4A illustrates an unengaged state of the female connector 10F and the male connector 10M of the first embodiment as illustrating in FIG. 3B. Here, consider the case where plural movable connectors 10 are provided between the daughter board 1 and the mother board 4, and when positions of the male connector 10M and the female connector 10F of any one movable connector 10 are adjusted, the male connector 10M of another movable connector 10 is misaligned with the female connector 10F by the maximum tolerance. It is assumed that the male connector 10M is directly soldered to a surface pattern 7 of the daughter board 1.

Figure 4B:
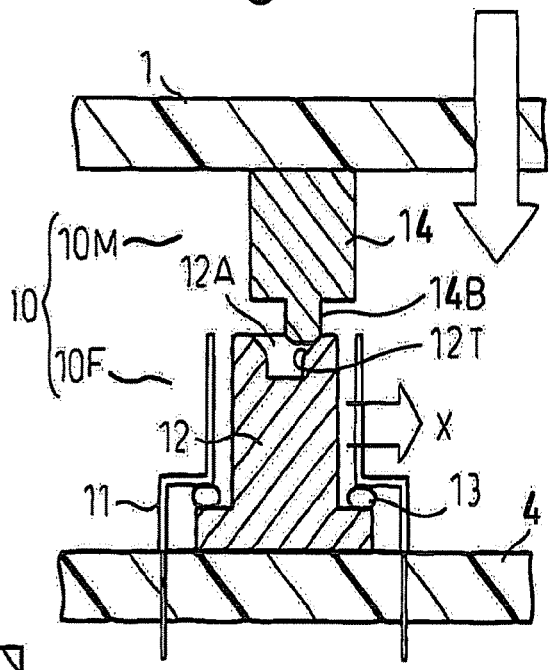
FIG. 4B illustrates half-engaged states of the male connector and the female connector from the state in FIG. 4A.
Figure 4C:
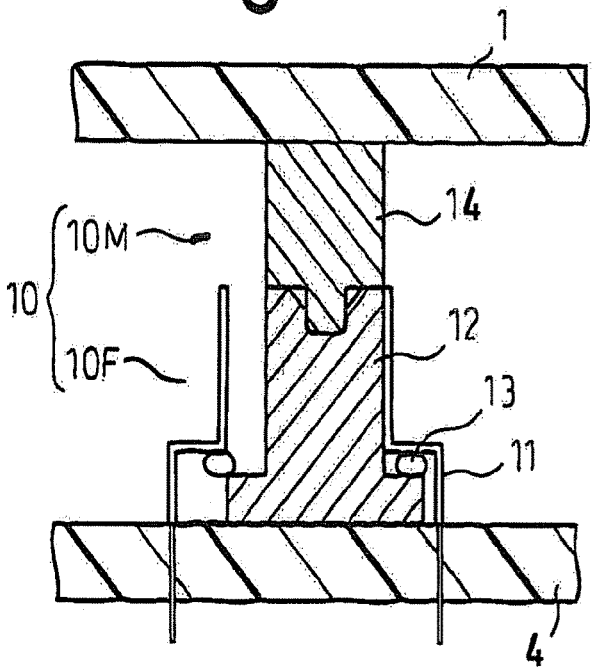
FIG. 4C illustrates engaged states of the male connector and the female connector from the state in FIG. 4B.

If the daughter board 1 is brought near to the mother board 4 with the male connector 10M being misaligned with the female connector 10F, as illustrating in FIG. 4B, a tip end of the projection 14B of the stationary side electrode 14 comes into abutment with the taper surface 12T of the recess 12A of the movable side electrode 12. If the daughter board 1 is brought closer to the mother board 4 in this state, the tip end of the projection 14B of the stationary side electrode 14 presses the taper surface 12T of the recess 12A of the movable side electrode 12, with the result that the movable side electrode 12 is moved in the direction of the arrow X. Then, if the daughter board 1 is mounted to the mother board 4, the movable side electrode 12 is moved to a position just below the stationary side electrode 14 in the housing 11, that is, a correct engagement position and fitted into the stationary side electrode 14.

As described above, in the movable connector 10 of the first embodiment, at the time of mounting the mother board 4 to the daughter board 1, even if the male connector 10M attached to the daughter board 1 is misaligned with the female connector 10F attached to the mother board 4, the male connector 10M and the female connector 10F are properly fitted into each other by the movable side electrode 12 moving in the female connector 10F. In the description of the first embodiment, the female connector 10F is attached to the mother board 4 and the male connector 10M is attached to the daughter board 1, but it is possible to attach the female connector 10F to the daughter board and the male connector 10M to the mother board.

By arranging the plural movable connectors 10 of the first embodiment between the mother board 4 and the daughter board 1, the connectors can supply a large current from the daughter board 1 to the mother board 4 as appropriate, insofar as each connector is structured such that the outer dimension of the housing 11 is about 5 mm if a distance between the mother board 4 and the daughter board 1 is about 10 to 15 mm.

Figure 5A:
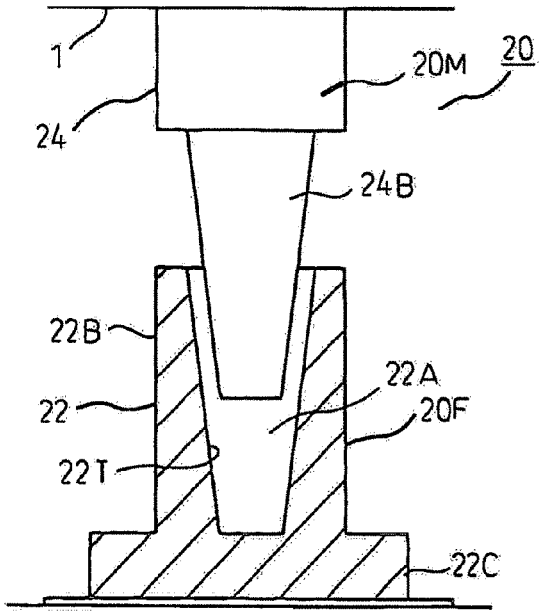
FIG. 5A is a sectional view illustrating shapes of a female connector and male connector of a movable connector according to a second embodiment.

FIG. 5A illustrates the structure of a female connector 20F and a male connector 20M of a movable connector 20 according to a second embodiment. In FIG. 5A, a housing put on the female connector 20F and an elastic member are omitted. The second embodiment differs from the first embodiment only in terms of the shape of a projection 24B of a stationary side electrode 24 and the shape of a recess 22A of a movable side electrode 22. In the second embodiment, the projection 24B of the stationary side electrode 24 has a truncated cone shape. Conforming to the shape, the recess 22A of the movable side electrode 22 has a truncated cone shape. The housing may be similar to that of the first embodiment.

As in the second embodiment, provided that the projection 24B of the stationary side electrode 24 has a truncated cone shape and the recess 22A of the movable side electrode 22 also has a truncated cone shape, in the case where the female connector 20F and the male connector 20M are misaligned and the projection 24B of the stationary side electrode 24 comes into abutment with the recess 22A of the movable side electrode in this state, the movable side electrode 22 can be smoothly moved. This is due to a high point of action at which the movable side electrode 12 is slid sideways when the projection 14B of the stationary side electrode 14 comes into abutment with the taper surface 12T of the movable side electrode 12 in the first embodiment, while in the second embodiment, a point of action at which the projection 24B of the stationary side electrode 24 comes into abutment with a taper surface 22T of the recess 22A of the movable side electrode 22, is high just after the projection came into abutment therewith but is gradually lowered along with the insertion of the projection 24B into the recess 22A, and a force of sliding the projection sideways can be applied near the large diameter portion 22C.

Figure 5B:
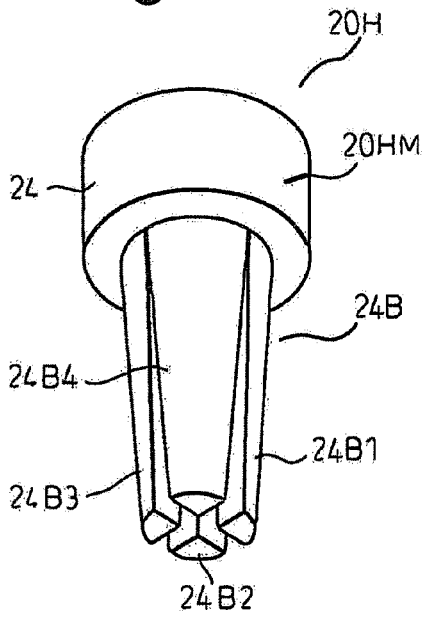
FIG. 5B is a perspective view illustrating a shape of a male connector of a movable connector as a modified example of the second embodiment.

FIG. 5B illustrates a shape of a male connector 20HM of a movable connector 20H as a modified example of the second embodiment. FIG. 5B illustrates the male connector 20HM alone. The female connector and the housing may be the same as those of the second embodiment and thus are omitted. The modified example of the second embodiment differs from the second embodiment only in that the projection 24B of the stationary side electrode 24 is divided into four, projections 24B1 to 24B4. The four projections 24B1 to 24B4 have conductivity and spring property and if compressed, deforms to a truncated cone shape as in the second embodiment.

Figure 5C:
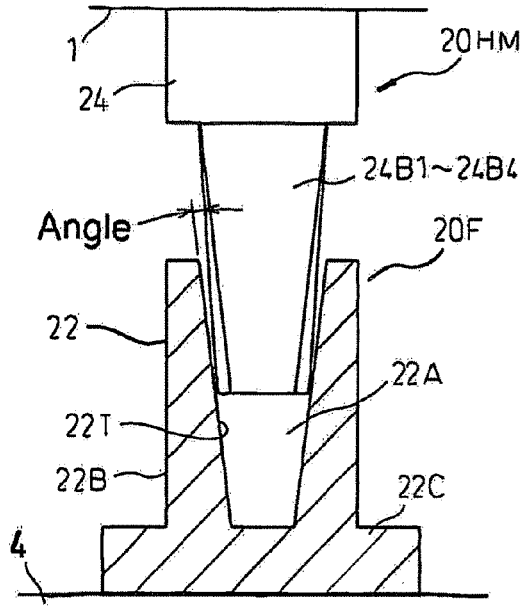
FIG. 5C is a sectional view illustrating unengaged states of the male connector and female connector of FIG. 5B.

FIG. 5C illustrates unengaged states of the male connector 20HM in FIG. 5B and the female connector 20F. In the modified example of the second embodiment, even if positions (positions of central axes) of the female connector 20F and the male connector 20HM are aligned, the angle of the taper surface of each of the projections 24B1 to 24B4 is obtuse as compared with the angle of the taper surface 22T of the recess 22A of the movable side electrode 22 and thus, the projections 24B1 to 24B4 come into abutment with the taper surface 22T of the recess 22A. Then, the projections 24B1 to 24B4 come near each other along with the insertion of the projections 24B1 to 24B4 to the recess 22A of the movable side electrode 22.

Figure 5D:
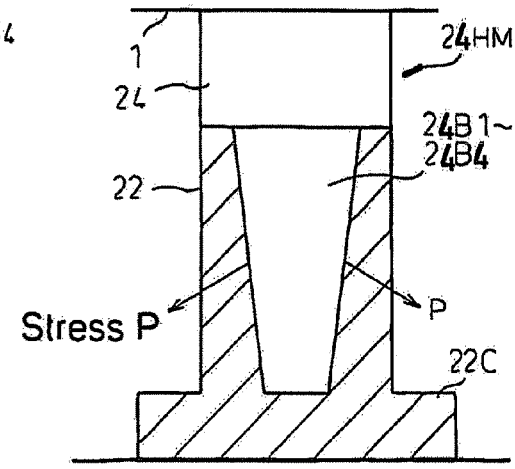
FIG. 5D is a sectional view illustrating engaged states of the male connector and female connector of FIG. 5B.

FIG. 5D illustrates engaged states of the male connector 20HM and the female connector 20F in FIG. 5C. In the illustrated example, the projections 24B1 to 24B4 of the stationary side electrode 24 are completely inserted to the recess 22A of the movable side electrode 22. In this state, the projections 24B1 to 24B4 of the stationary side electrode 24, which have spring property, are subjected to a stress to expand in the direction of the arrow P, so the male connector 20HM and the female connector 20F are firmly engaged together.

Figure 6A:
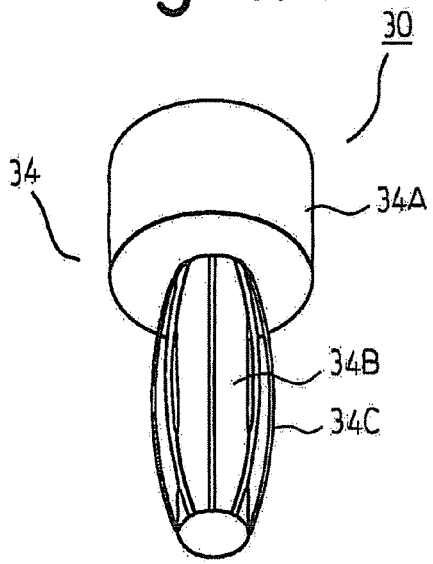
FIG. 6A is a perspective view of a shape of a male connector of a movable connector according to a third embodiment.
Figure 6B:
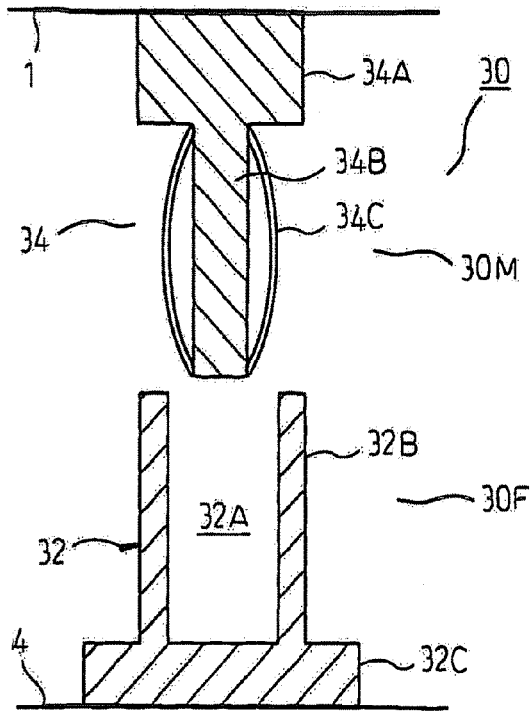
FIG. 6B is a sectional view illustrating shapes and unengaged states of a female connector and the male connector of the movable connector of the third embodiment.

FIG. 6A illustrates a shape of a male connector 30M of a movable connector 30 according to a third embodiment. FIG. 6B illustrates shapes and unengaged states of the male connector 30M and a female connector 30F of the movable connector 30 of the third embodiment. In FIG. 6B, the housing and the elastic member are not illustrated. In the third embodiment, a stationary side electrode 34 constituting the male connector 30M is composed of a cylindrical base portion 34A, a cylindrical projection 34B protruding from the base portion 34A, and plural wire springs 34C stretched around the projection 34B. THE diameter of the projection 34B is smaller than that of the base portion 34A, and the springs 34C are stretched between a fee end of the projection 34B and the base portion in the form of curving outwardly.

On the other hand, a movable side electrode 32 constituting the female connector 30F is composed of a cylindrical small diameter portion 32B and a cylindrical large diameter portion 32C. A cylindrical recess 32A is formed at the top of the small diameter portion 32B. The diameter of the recess 32A is set smaller than the maximum diameter of a polygon defined by connecting the outermost positions of the plural springs 34C stretched around the projection 34B of the stationary side electrode 34, along the outer periphery of the projection 34B. A housing and an elastic member similar to the housing 11 and the elastic member 13 can be used in the female connector 30F.

A description is given of an operation executed in the case where the male connector 30F and the female connector 30M are misaligned in the structure of the third embodiment where the plural springs 34C are stretched around the projection 34B of the stationary side electrode 34 to form the stationary side electrode 34 into a so-called banana jack shape, and the cylindrical recess 32A is formed in the movable side electrode 32. In the case where the male connector 30F and the female connector 30M are misaligned, if the daughter board 1 is brought close to the mother board 4, the springs 34C stretched around the projection 34B of the stationary side electrode 34 comes into abutment with an inner peripheral surface of the recess 32 of the movable side electrode 32.

Figure 6C:
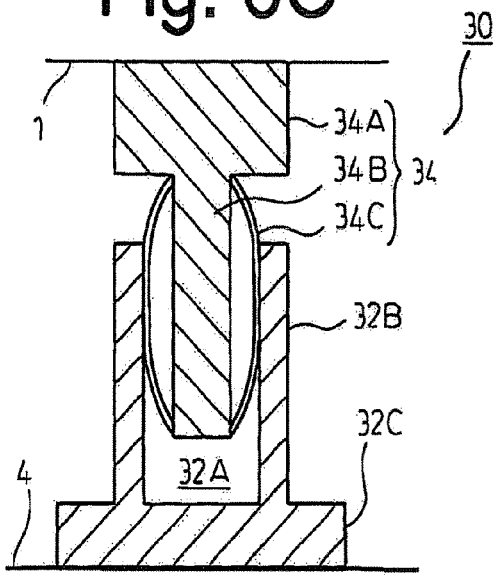
FIG. 6C is a sectional view illustrating half-engaged states of the male connector and female connector of FIG. 6B.
Figure 6D:
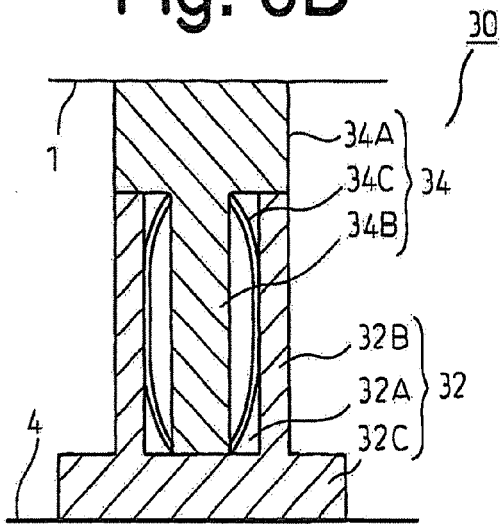
FIG. 6D is a sectional view illustrating engaged states of the male connector and female connector of FIG. 6B.

Since the outer surfaces of the springs 34C are curved, the springs 34C press the movable side electrode 32 along with the insertion of the projection 34B of the stationary side electrode 34 into the recess 32A of the movable side electrode 32, and the movable side electrode 32 moves sideways. FIG. 6C illustrates a state in which the projection 34B of the stationary side electrode 34 is inserted halfway through the recess 32A of the movable side electrode 32. FIG. 6D illustrates a state in which the projection 34B of the stationary side electrode 34 is inserted completely into the recess 32A of the movable side electrode 32. The number of springs 34C stretched around the projection 34B of the stationary side electrode 34 is not limited to the value of this embodiment. The springs 34C are conductive metal.

Figure 7A:
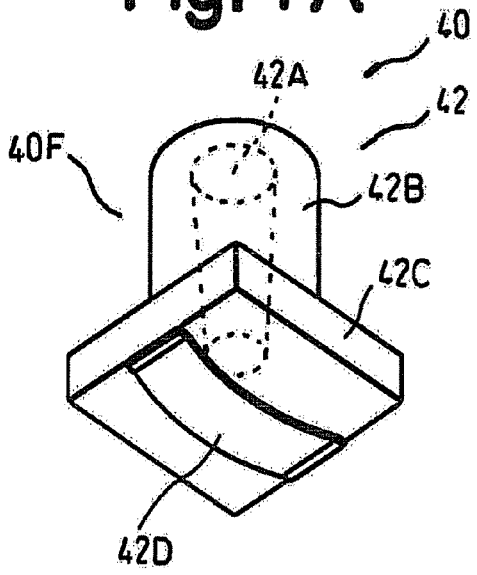
FIG. 7A is a perspective view of a shape of a female connector of a movable connector according to a fourth embodiment.

FIG. 7A illustrates a shape of a female connector 40F of a movable connector 40 according to a fourth embodiment. In FIG. 7A, the male connector, the elastic member, and the housing are omitted. As the male connector of the fourth embodiment, the male connector 20M of the second embodiment as illustrating in FIG. 5A or the male connector 20HM of the modified example of the second embodiment as illustrating in FIG. 5B can be used. In the fourth embodiment, a movable side electrode 42 constituting the female connector 40F is composed of a small diameter portion 42B having a recess 42A, and a large diameter portion 42C. The large diameter portion 42C has a prism shape, and a curved plate spring 42D is attached to the bottom thereof.

Figure 7B:
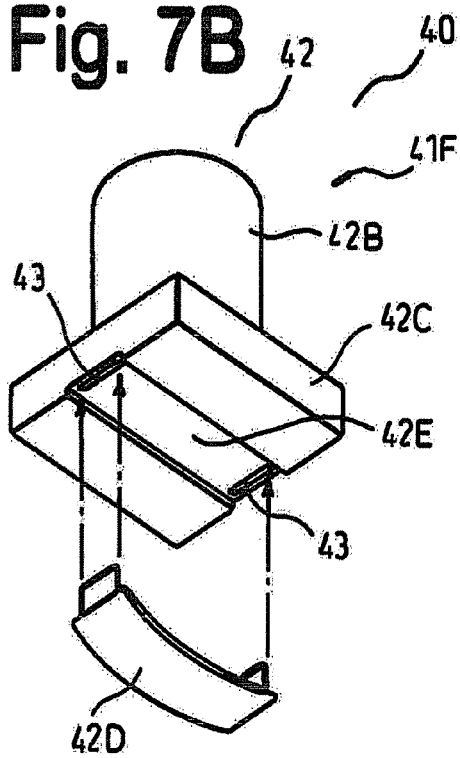
FIG. 7B is a perspective view of a shape of a female connector of a movable connector as a modified example of the fourth embodiment.

FIG. 7B illustrates a shape of a female connector 41F of the movable connector 40 as a modified example of the fourth embodiment. In FIG. 7B, the male connector, the elastic member, and the housing are omitted. As the male connector of the fourth embodiment, the male connector 20M of the second embodiment as illustrating in FIG. 5A or the male connector 20HM of the modified example of the second embodiment as illustrating in FIG. 5B can be used. In the modified example of the fourth embodiment, a movable side electrode 42 constituting the female connector 41F includes a small diameter portion 42B having a recess (not illustrating) and a large diameter portion 42C. The large diameter portion 42C has a square pole shape, and a spring holding groove 42E is formed at the bottom thereof. A curved plate spring 42D is attached with both ends being inserted to mounting holes 43 formed at both ends of the spring holding groove 42.

Figure 7C:
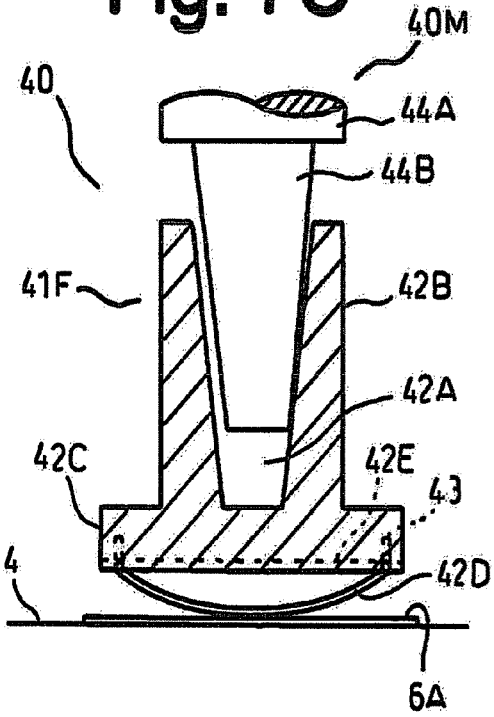
FIG. 7C is a sectional view of half-engaged states of a male connector and female connector of FIG. 7B.
Figure 7D:
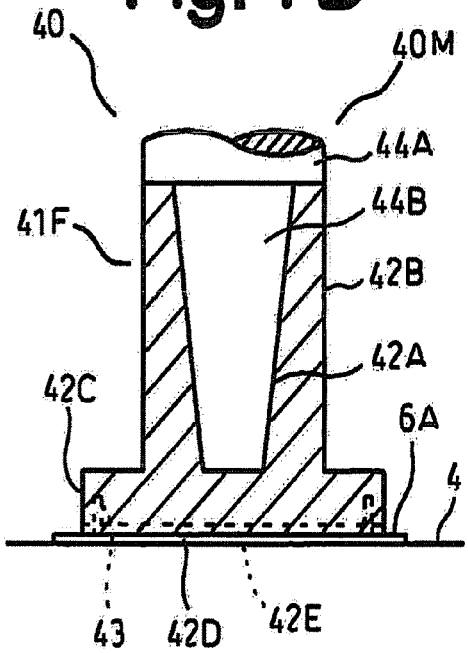
FIG. 7D is a sectional view of engaged states of the male connector and female connector of FIG. 7C.

FIG. 7C illustrates a state in which a male connector 40M is engaged halfway through the female connector 41F. In this state, the plate spring 42D protrudes from the spring holding groove 42E formed at the bottom of the large diameter portion 42C. FIG. 7D illustrates a state in which the male connector 40M and the female connector 41F of FIG. 7C are fitted into each other. The male connector 40M includes a base portion 44A and a projection 44B for a stationary side electrode. The projection 44B is formed in a trunked cone shape and fits into the recess 42A. When the male connector 40M is fitted into the female connector 41F, the plate spring 42D is accommodated into the spring holding groove 42E. As a result, the bottom of the large diameter portion 42C comes into contact with the land portion 6A of the circuit pattern. The plate spring 42D is conductor.

Figure 8:
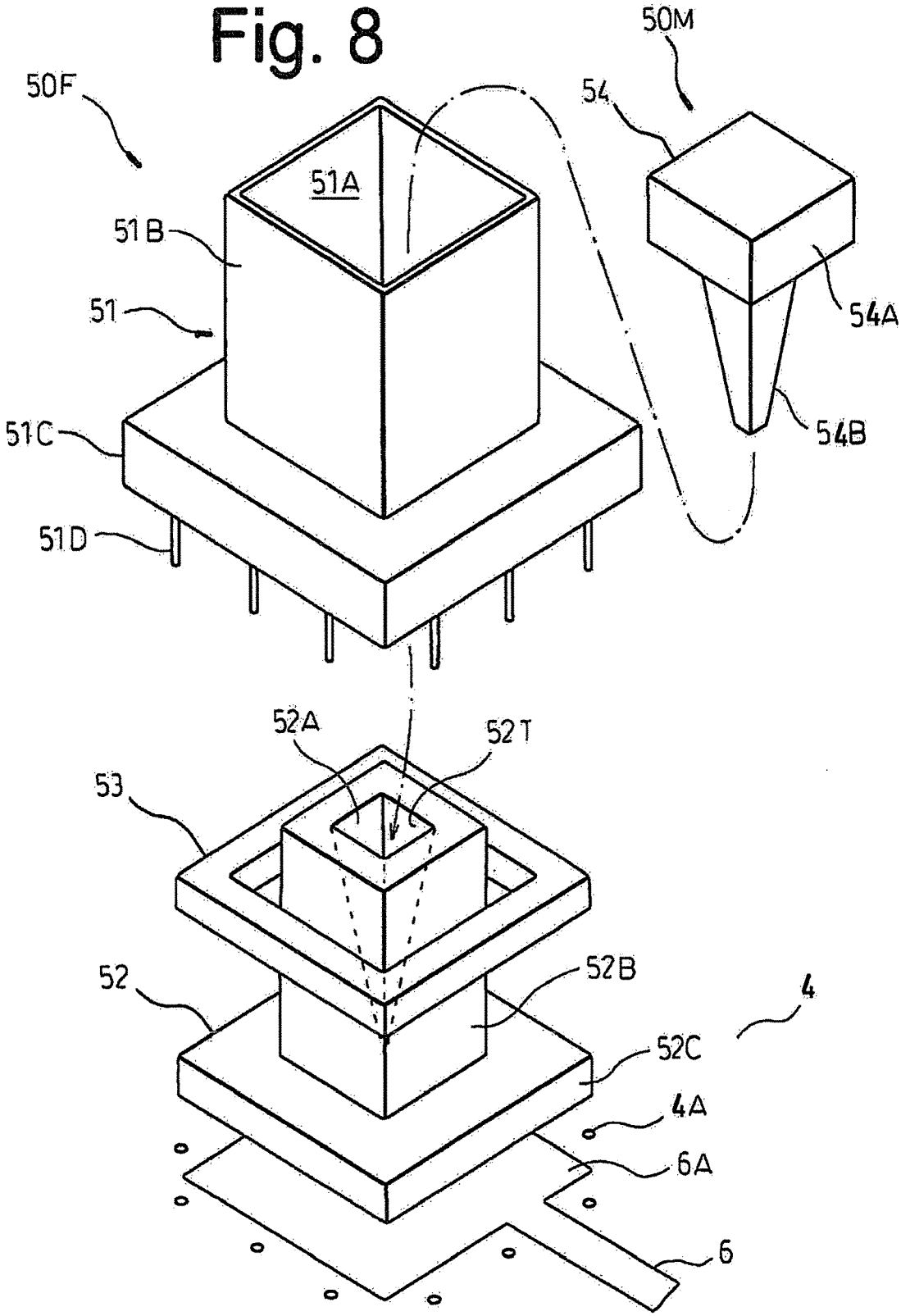
FIG. 8 is an exploded perspective view of the structure of a female connector and male connector of a movable connector according to a fifth embodiment.

FIG. 8 illustrates the structures of a female connector 50F and a male connector 50M of a movable connector 50 according to a fifth embodiment. The female connector 50F is composed of a housing 51, a movable side electrode 52, and an elastic member 53. The housing 51 of the fifth embodiment has a square pole shape and includes a small diameter portion 51B having an opening 51A, and a large diameter portion 51C having the inner dimension larger than that of the small diameter portion 51B. Plural lead terminals 51D extend from the lower edge of the large diameter portion 51C. In the fifth embodiment, the quadrangle land portion 6A of the circuit pattern 6 is formed at a mounting position of the housing 51 on the mother board 4, and mounting holes 4A for mounting the housing 51 are formed around the land portion 6A. The housing 51 is fixed onto the mother board 4 by inserting the lead terminals 51D into the mounting holes 4A formed in the mother board 4.

The movable side electrode 52 is made of a conductive material, and has a square pole shape and includes a small diameter portion 52B having a recess 52A formed at the top thereof, and a large diameter portion 52C having the outer dimension larger than that of the small diameter portion 52B. Since the movable side electrode 52 is accommodated inside the housing 51, the outer dimension of the small diameter portion 52B of the movable side electrode 52 is smaller than the inner dimension of the small diameter portion 51B of the housing 51 by a predetermined amount, and the outer dimension of the large diameter portion 52C is smaller than the inner dimension of the large diameter portion 51C of the housing 51 by a predetermined amount. The recess 52A has a taper surface 52T.

The elastic member 53 has a quadrangle frame shape with the outer dimension substantially the same as the outer dimension of the large diameter portion 52C of the movable side electrode 52. The small diameter portion 52B of the movable side electrode 52 is passed through the elastic member 53, and the elastic member is put on the top of the large diameter portion 52C. The female connector 50F is mounted onto the mother board 4 such that the movable side electrode 52 is first placed on the land portion 6A on the mother board 4, the elastic member 53 is next placed on the movable side electrode 52, and the housing 51 covers the elastic member. Under the condition that the lead terminals 51D of the housing 51 are soldered and fixed to the mother board 4, the elastic member 53 is compressed to press the bottom of the movable side electrode 52 against the mother board 4 and bring the bottom into contact therewith. The male connector 50M includes a stationary side electrode 54. The stationary side electrode 54 includes a base portion 54A and a projection 54B. The projection 54B is formed in a pyramid shape and fits into the recess 52A.

As described above, in the fifth embodiment, the female connector 50F and the male connector 50M of the movable side electrode 50 are formed into a quadrangle (e.g. square) shape in cross-section. This is because the mounting tolerance of the connector is on the order of 0.1 mm and thus, the misalignment of the male connector can be dealt with by the movement of the female connector albeit the quadrangle (e.g. square) cross-sectional shape. Besides the shape of this embodiment, the female connector and the male connector of the movable side electrode may have a polygonal cross-sectional shape.

Although the above first to fifth embodiments describe the single-pole movable connector, the movable connector may have plural poles. Hereinbelow, referring to FIGS. 9 to 11, the structure of a movable connector having two poles will be described.

Figure 9A:
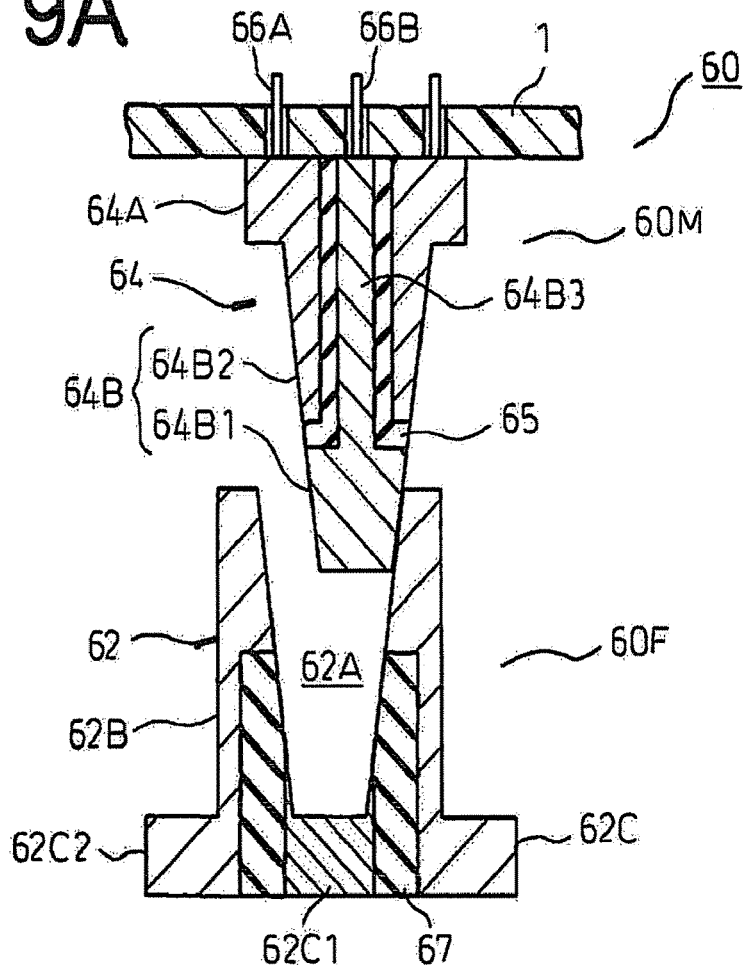
FIG. 9A is a sectional view illustrating shapes and half-engaged states of a female connector and male connector of a movable connector according to a sixth embodiment.
Figure 9B:
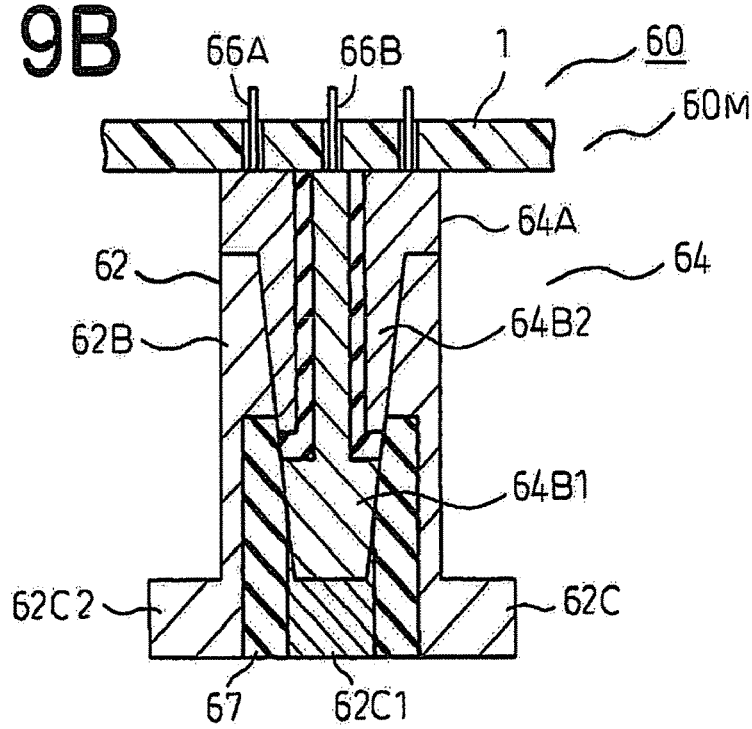
FIG. 9B is a sectional view illustrating engaged states of the male connector and female connector of FIG. 9A.

FIG. 9A illustrates the structure of a female connector 60F and a male connector 60M of a movable connector 60 according to a sixth embodiment. FIG. 9A illustrates half-engaged states of the female connector 60F and the male connector 60M. FIG. 9B illustrates engaged states of the female connector 60F and the male connector 60M of FIG. 9A. In the sixth embodiment, the outer shapes of the female connector 60F and the male connector 60M are similar to the outer shapes of the female connector 20F and the male connector 20M of the second embodiment as illustrating in FIG. 5A. Accordingly, a process of engagement between the female connector 60F and the male connector 60M from the state of FIG. 9A to the state of FIG. 9B is similar to that of the second embodiment and thus, its description is omitted. Further, its housing and elastic member may be the same as the housing and the elastic member of the first embodiment and thus are not illustrated.

In the sixth embodiment, a projection 64B of a stationary side electrode 64 is formed into a truncated cone shape. The projection 64B is divided into two, an electrode 64B1 at the tip end side and an electrode 64B2 at the base portion side along a horizontal direction by an insulating member 65. The electrode 64B1 at the tip end side is guided to the bottom of a base portion 64A of the stationary side electrode 64 by a lead portion 64B3 insulated from surrounding portions through the insulating member 65 and connected to a not-illustrated circuit pattern of the daughter board 1 by means of a lead terminal 66B protruding from the bottom. The electrode 64B2 at the base portion side is connected to the base portion 64A of the stationary side electrode 64 and thus, connected to a not-illustrated circuit pattern on the daughter board 1 by means of at least one lead terminal 66A protruding from the bottom of the base portion 64A.

On the other hand, the movable side electrode 62 has a recess 62A formed in a truncated cone shape conforming thereto. The inner portion of the recess 62A is divided into two by an insulating member 67. In other words, the movable side electrode 62 is divided into a first electrode 62C1 to be brought into contact with the electrode 64B1 at the tip end side and a second electrode 62C2 to be brought into contact with the electrode 64B2 at the base portion side using the insulating member 67. The circuit pattern on the mother board may be formed in accordance with the shapes of the first electrode 62C1 and the second electrode 62C2. With the above structure, one movable connector 60 can have two electrodes.

Figure 10A:
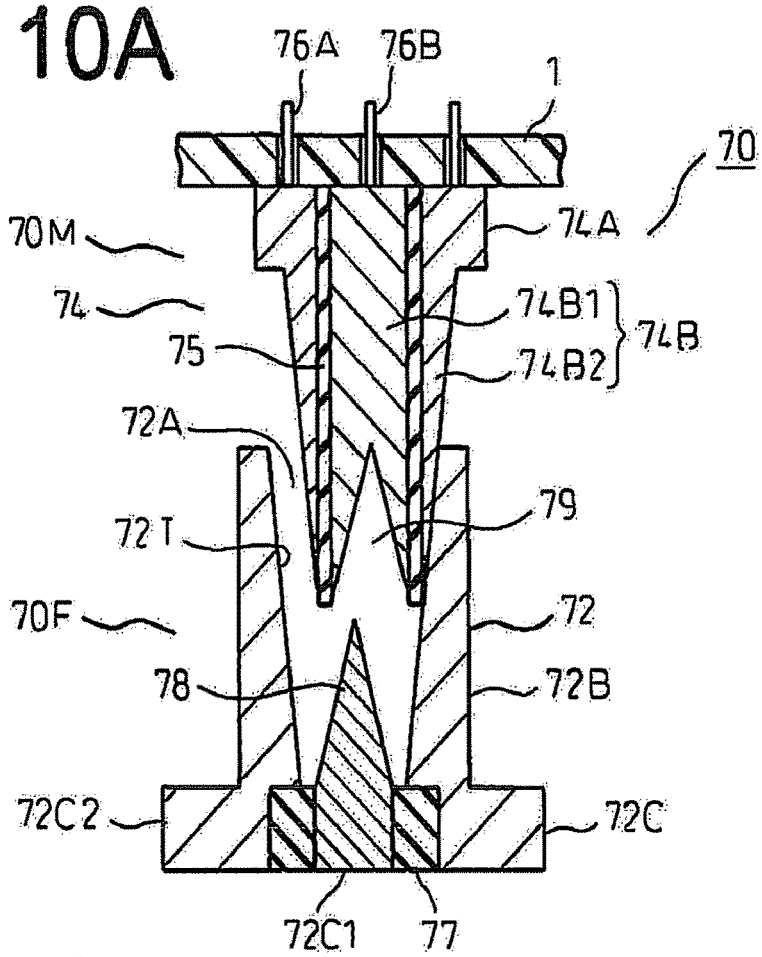
FIG. 10A is a sectional view illustrating shapes and half-engaged states of a female connector and male connector of a movable connector according to a seventh embodiment.
Figure 10B:
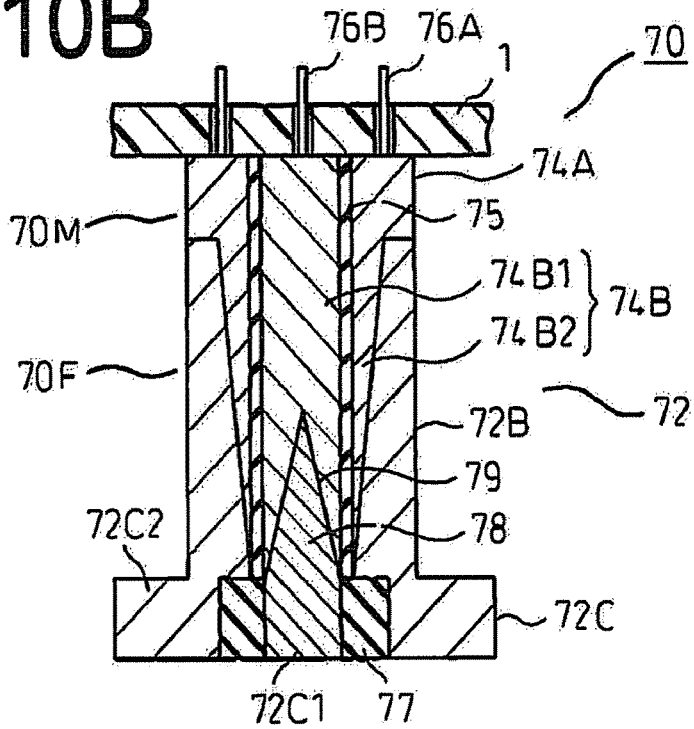
FIG. 10B is a sectional view illustrating engaged states of the male connector and female connector of FIG. 10A.

FIG. 10A illustrates the structure of a female connector 70F and a male connector 70M of a movable connector 70 according to a second embodiment. FIG. 10A illustrates half-engaged states of the female connector 70F and the male connector 70M. FIG. 10B illustrates engaged states of the male connector 70M and the female connector 70F of FIG. 10A. In the seventh embodiment, the outer shapes of the female connector 70F and the male connector 70M are substantially the same as the outer shapes of the female connector 20F and the male connector 20M of the second embodiment as illustrating in FIG. 5A. Further, its housing and elastic member may be the same as the housing and the elastic member of the first embodiment and thus are not illustrated.

In the seventh embodiment, a projection 74B of a stationary side electrode 74 has a truncated cone shape, and a conical engagement cavity 79 is formed at the top of the projection 74B. Further, the projection 74B is divided into two, an inner electrode 74B1 including the top and the engagement cavity 79 and an outer electrode 74B2 by a cylindrical insulating member 75. The inner electrode 74B1 extends up to the bottom of a base portion 74A of the stationary side electrode 74 and is connected to a not-illustrated circuit pattern on the daughter board 1 by means of a lead terminal 76B protruding from the bottom. The outer electrode 74B2 is connected to the base portion 74A of the stationary side electrode 74 and thus can be connected to a not-illustrated circuit pattern on the daughter board 1 by means of at least one lead wire 76A protruding from the bottom of the base portion 74A.

On the other hand, conforming to the above shapes, a recess 72A of the movable side electrode 72 has a truncated cone shape as well as a conical projection 78 to be fitted to the conical engagement cavity 79 is formed at the bottom of the recess 72A. The projection 78 may have a truncated cone shape. Further, a taper surface 72T as an inner surface of the recess 72A and the projection 78 are insulated from each other using a cylindrical insulating member 77. In other words, the movable side electrode 72 is divided into a first electrode 72C1 to be brought into contact with the inner electrode 74B1 and a second electrode 72C2 to be brought into contact with the electrode 74B2 at the base portion side by the insulating member 77. THE circuit pattern on the mother board may be formed in accordance with the shapes of the first electrode 72C1 and the second electrode 72C2. With the above structure, one movable connector 70 can have two electrodes.

In the seventh embodiment, in a process of engagement between the female connector 70F and the male connector 70M from the half-engaged state of FIG. 10A to the engaged state of FIG. 10B, the projection 78 is inserted to the engagement cavity 79 while the electrode 74B2 at the base portion side of the male connector 70M comes into abutment with the taper surface 72T of the recess 72A and the female connector 70F is moved. In this way, if the projection 78 is formed on the first electrode 72C1 and the engagement cavity 79 is formed at the top of the inner electrode 74B1, the first electrode 72C1 and the inner electrode 74B1 can be electrically connected without fail upon engagement of the female connector 70F and the male connector 70M.

Figure 11:
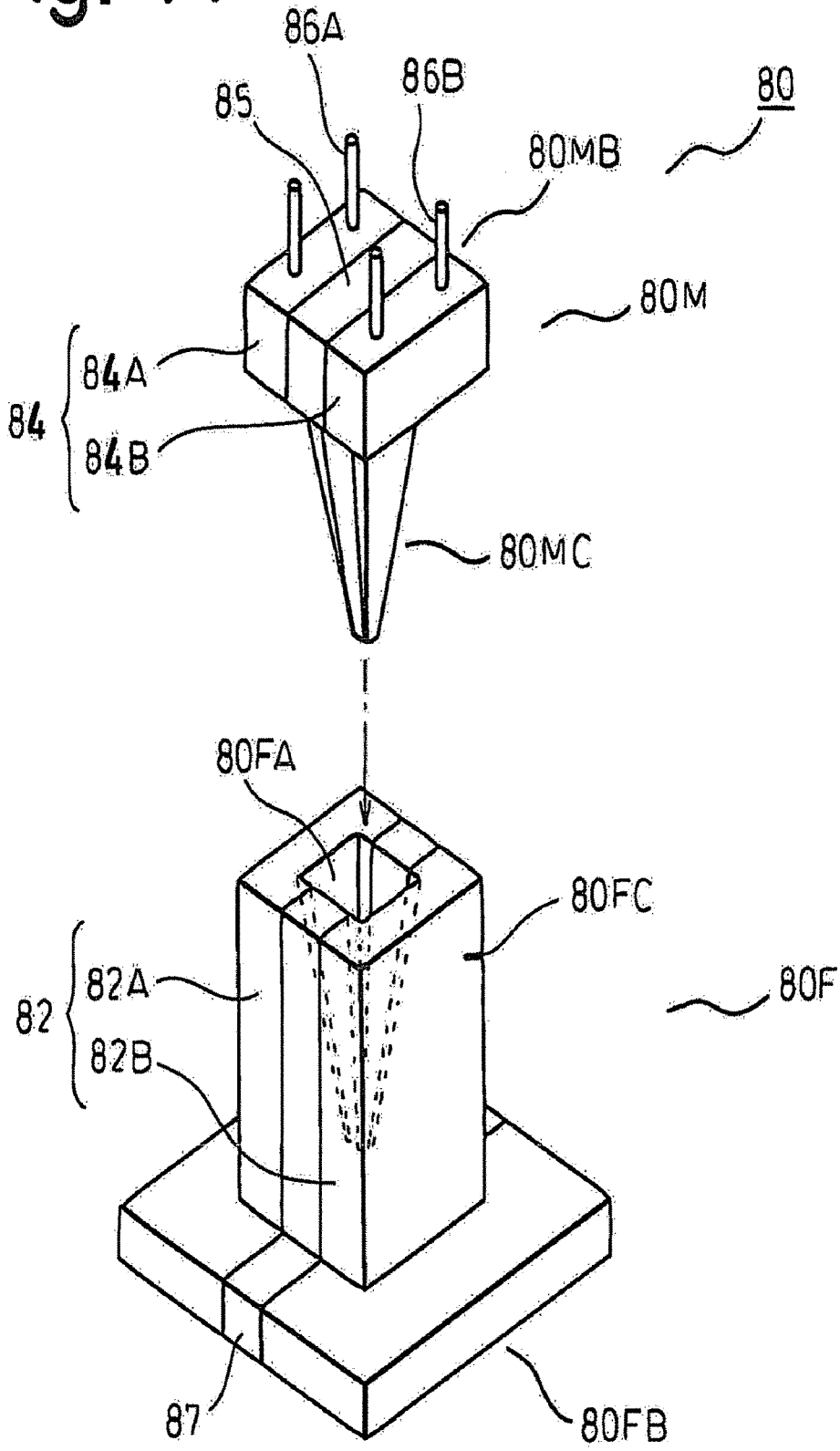
FIG. 11 is an exploded perspective view of the structure of a female connector and male connector of a movable connector according to an eighth embodiment.

FIG. 11 illustrates the structure of a female connector 80F and a male connector 80M of a movable connector 80 according to an eighth embodiment. The movable connector 80 of the eighth embodiment is a bipolar connector, which is composed of the female connector 80F including a movable side electrode 82 composed of a first movable side electrode 82A and a second movable side electrode 82B, and the male connector 80M including a stationary side electrode 84 composed of a first stationary side electrode 84A and a second stationary side electrode 84B. Here, its housing and elastic member may be the same as the housing 51 and the elastic member 53 of the fifth embodiment as illustrating in FIG. 8 and thus are not illustrated.

In the eighth embodiment, a base portion 80MB of a male connector 80M is formed into a square pole shape, and a connector portion 80MC protruding from the base portion 80MB has a truncated pyramid shape. The entire male connector 80M is divided into two, the first stationary side electrode 84A and the second stationary side electrode 84B symmetrical with respect to its axial line by an insulating member 85 having a predetermined thickness. Further, a base portion 80FB of the female connector 80F has a square pole shape, and a connector portion 80FC protruding from the base portion 80FB has a square pole shape. Further, a recess 80FA of a truncated pyramid shape is formed at the top of the connector portion 80FC. The entire female connector 80F is divided into two, the first movable side electrode 82A and the second movable side electrode 82B symmetrical with respect to its axial line by an insulating member 87 having a predetermined thickness. The insulating members 85 and 87 may be different in thickness.

Lead terminals 86A and 86B protrude from the first stationary side electrode 84A and the second stationary side electrode 84B, respectively, so as to be connected to a circuit pattern on a not-illustrating daughter board where the male connector 80M is mounted. In the case where the male connector 80M of the movable connector 80 is mounted to one circuit board (daughter board) and the female connector 80F is mounted to the other circuit board (mother board), the insulating members 85 and 87 may be directed toward the same direction. With the above structure, one movable connector 80 can have two electrodes. If being divided into more sub portions, one movable connector 80 can have more poles.

The present invention is described in detail above based on the preferred embodiments. To facilitate the understanding of the present invention, specific modes of the present invention are appended below.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

What is claimed is:

1. A connector for electrically connecting with a first circuit board and a second circuit board, the connector comprising:

a female connector including;

a housing having a terminal and an opening, the opening arranged on the top of the housing and having an inner size, the terminal arranged at bottom side of the housing and fixing on the first circuit board, a moveable side electrode having a diameter smaller than the inner size of the opening and a recess on top of the housing, the moveable side electrode arranged in the housing between the housing and the first circuit board, the moveable side electrode capable of moving in the housing, and an elastic member arranged between the housing and the moveable side electrode, the elastic member urging to the moveable side electrode and for contact between a circuit pattern on the first circuit board and the moveable side electrode when the housing sets on the first circuit board; and a male connector including:

a base portion fixed the second circuit board; and a stationary side electrode including a projection with a tip end, the tip end being fitted into the recess of the moveable side electrode.

2. The connector of claim 1, wherein the housing is formed in a cylindrical shape.

3. The connector of claim 1, wherein:

the inner size of the opening of the housing has a first inner size and a second inner size larger than the first inner size, the second inner size arranged on the first circuit board side, and the moveable side electrode has a first diameter and a second diameter larger than the first diameter, the second diameter arranged on the first circuit board side.

4. The connector of claim 1, wherein:

the recess of the moveable side electrode is formed in a taper surface, and the projection of the stationary side electrode is formed in a taper surface to fit the recess of the movable side electrode.

5. The connector of claim 1, wherein:

the moveable side electrode is formed in a cylindrical shape, and the stationary side electrode is formed in a cylindrical shape.

6. The connector of claim 1, wherein:

the recess has a taper surface arranged at the top of the moveable side electrode and a cylindrical portion arranged at the bottom of the recess, the cylindrical portion being formed continuous to the taper surface, and the stationary side electrode has a shape to fit the recess of the movable side electrode.

7. The connector of claim 1, wherein:

the recess has a truncated cone shape, and the stationary side electrode has a shape to fit the recess of the movable side electrode.

* * * * *